US006234514B1

(12) United States Patent
Dubuque

(10) Patent No.: US 6,234,514 B1
(45) Date of Patent: May 22, 2001

(54) SKI HARNESS HEEL BAIL ASSEMBLY HAVING ENCLOSED SPRINGS AND RIGID TENSION MEMBERS

(76) Inventor: Armond K. Dubuque, 32901 138th St., SE., Sultan, WA (US) 98294

( * ) Notice: Subject to any disclaimer, the term of this patent is extended or adjusted under 35 U.S.C. 154(b) by 0 days.

(21) Appl. No.: 09/624,017

(22) Filed: Jul. 24, 2000

Related U.S. Application Data

(63) Continuation-in-part of application No. 09/193,157, filed on Nov. 17, 1998, now abandoned.

(51) Int. Cl.[7] ..... A63C 9/00
(52) U.S. Cl. ..... 280/619; 280/615; 280/621
(58) Field of Search ..... 280/615, 619, 280/620, 621, 622

(56) References Cited

U.S. PATENT DOCUMENTS 2,550,018 * 4/1951 Morrison et al. ..... 24/71 CT
2,907,574 * 10/1959 Goy et al. ..... 280/619
3,012,793 * 12/1961 Beyl ..... 280/621
5,499,838 * 3/1996 Hauglin et al. ..... 280/615
5,823,563 * 10/1998 Dubuque ..... 280/615
5,893,576 * 4/1999 Hauglin ..... 280/621

* cited by examiner

*Primary Examiner*—Paul N. Dickson
*Assistant Examiner*—Faye M. Fleming
(74) *Attorney, Agent, or Firm*—Robert W. Jenny

(57) ABSTRACT

The heel bail assembly incorporates tension members, such as rods, and compression springs, the springs being enclosed in casings. Each of two side tension members extend from the toe assembly of a ski harness into a casing. A U-shaped tension member extends from one casing around the ski boot heel to the other casing. Threaded connections of the side tension members to the casings enable adjustment of the length of the bail assembly.

2 Claims, 1 Drawing Sheet

FIG. 1
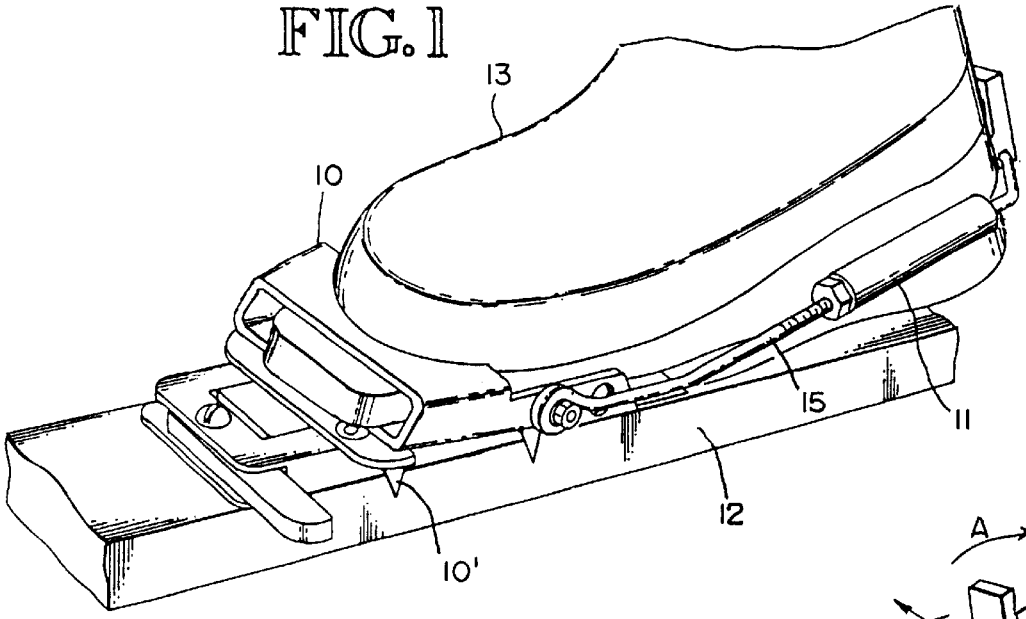
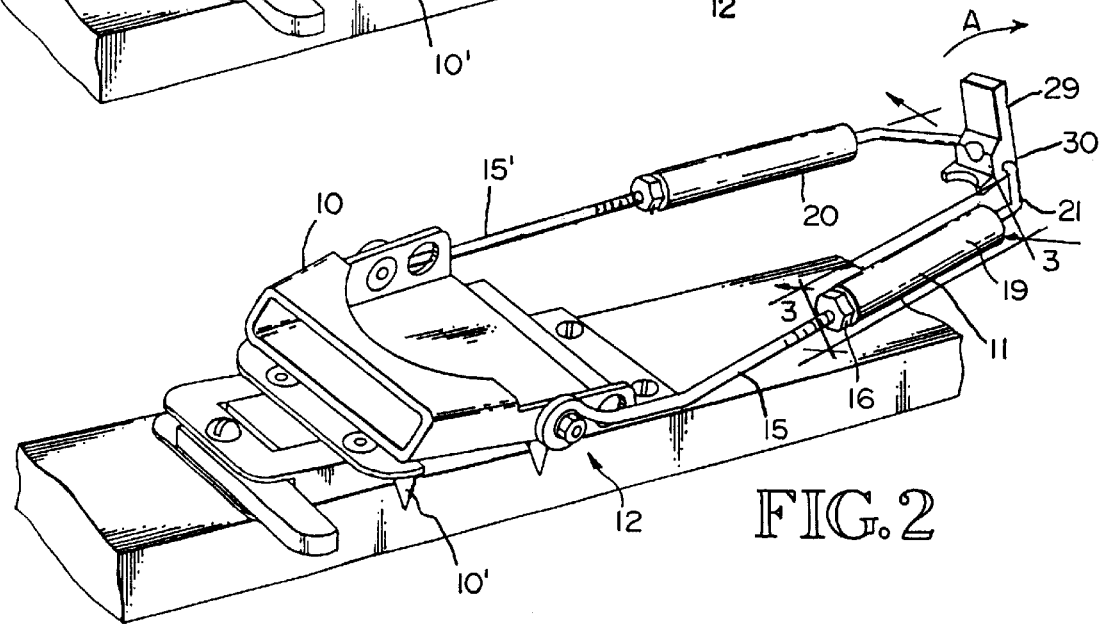
FIG. 2
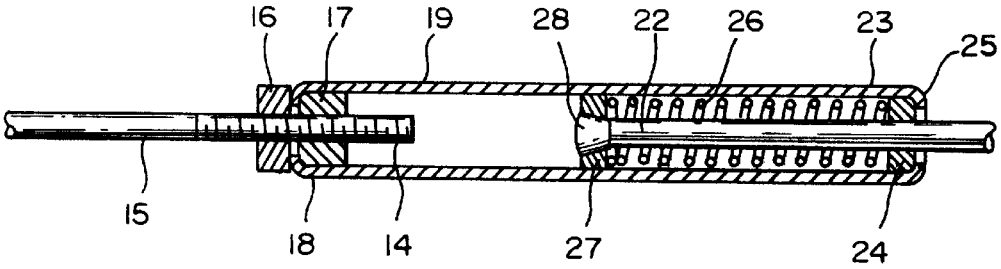
FIG. 3

SKI HARNESS HEEL BAIL ASSEMBLY HAVING ENCLOSED SPRINGS AND RIGID TENSION MEMBERS

This application is a Continuation-In-Part application based on application Ser. No. 09/193,157, filed Nov. 17, 1998, to be abandoned when this application is duly filed.

BACKGROUND OF THE INVENTION

1. Field

The subject invention is in the field of equipment related to snow skiing, particularly telemark ski harnesses, the apparatus used to detachably attach a ski boot to a cross country ski. More particularly, it is in the field of heel bails, the apparatus in a ski harness which holds the toe of the ski boot in the boot toe retaining portion of the harness.

2. Prior Art

Conventional prior art telemark bindings commonly incorporate tension springs in the heel bail. It is commonly known that these springs can be bent and/or overextended to the point that the binding is unsafe or useless. Further harnesses comprising tension springs and flexible cable tend to allow the user's foot to swing laterally somewhat relative to the ski, with the toe of the boot pivoting in the toe plate. Such lateral freedom, which is undesirable and degrades ski control, increases with conventional harnesses when the tension springs are over stressed. Further, such over stressing also causes the bindings to release too easily.

Accordingly, the primary objective of the subject invention is to provide a heel bail for telemark bindings which facilitates improved ski control and in which the springs cannot be over stressed.

SUMMARY OF THE INVENTION

The subject invention is a heel bail assembly which comprises rigid tension members, such as rods, compression springs, spring casings and an over-center clip. Two rigid tension members, such as side rods, are pivoted at their forward ends to the toe assembly of a ski harness and the other ends of these rods are threaded into the forward ends of the spring casings. These threaded connections are used to adjust the heel bail assembly. The ends of a third, generally U-shaped member extend into the back ends of the casings and engage the forward ends of the compression springs in the casings. The springs act between the forward ends of the U-shaped member and the back ends of the casings and are compressed as the heel bail assembly is stretched to fit onto the heel of a boot. The over-center clip is pivoted on the back portion of the U-shaped member and acts to stretch the heel bail assembly and to retain it on the boot heel. The invention is described in more detail below, with reference to the attached drawings.

BRIEF DESCRIPTION OF THE DRAWINGS

FIG. 1 illustrates the subject invention in use on a telemark ski harness with a ski boot attached by the harness to a ski.

FIG. 2 illustrates the ski harness incorporating the subject invention with no boot being retained.

FIG. 3 is a sectional view taken at 3—3 in FIG. 2.

DETAILED DESCRIPTION OF THE INVENTION

The subject invention is a heel bail assembly for use on telemark ski harnesses. In FIG. 1 ski harness 10, incorporating heel bail assembly 11, is holding ski 12 attached to boot 13. The ski harness shown also comprises crampon 10'. A telemark ski binding incorporating a crampon is covered by U.S. Pat. No. 5,823,563. FIG. 2 illustrates the ski harness and heel bail assembly with no ski boot in place.

FIG. 3 is a section taken at 3—3 in FIG. 2, showing the installation of one of the springs in the heel bail assembly. End 14 of rod 15 (tension member) is threaded and lock nut 16 and fitting 17 are threaded onto it, fitting 17 being attached to end 18 of casing 19 by swaging end 18 around fitting 17. To adjust the length of the heel bail assembly casings 19 and 20 (FIG. 2), are rotated and the lock nuts are tightened to set the adjustments. Each of the ends of U-shaped tension member 21, end 22 being typical, extends into end 23 of a casing through end fitting 24, retained in the casing by swaging of end 25. End 22 extends through compression spring 26 and spring retention fitting 27 which is held on end 22 by formed head 28. Tension loads in the heel bail assembly compress the springs. Over-center clip 29 on end portion 30 of tension member 21 serves to apply compression forces on the springs in the casings and to retain the heel bail assembly on a ski boot heel. Rotating the clip 90° or more in the direction of arrow A allows clearance for installing the bail assembly on the boot heel. Rotating the clip in the opposite direction to arrow A applies the compression force.

It is considered to be understandable from this description that the subject invention meets its objectives. It provides a heel bail assembly which facilitates improved ski control because of the use of rigid tension members instead of cables in the bail assembly. Also, the spring in the heel bail assembly cannot be over stressed or bent because they are compression springs installed so that their maximum defection is mechanically limited and they are fully enclosed.

It is also considered to be understood that while one configuration of the subject invention is described herein, other configurations and modifications of the one described are possible within the scope of the subject invention which is limited only by the attached claims.

I claim:

1. A heel bail assembly for use in a telemark ski harness having a toe assembly, said heel bail assembly comprising first, second and third tension members, an over-center clip, first and second compression springs, first and second casings, and first and second spring retention fittings, said first and second compression springs being installed in said first and second casings respectively, each of said tension members having a first tension member end and a second tension member end, each of said casings having a first casing end having a fitting having a threaded hole and a second casing end having a hole, said first ends of said first and second tension members being attached to said toe assembly, said second end of said first tension member being threaded into said threaded hole in said fitting in said first casing end of said first casing, said second end of said second tension member being threaded into said threaded hole in said fitting in said first casing end of said second casing, said first end of said third tension member extending through said hole in said second end of said first casing, through said first compression spring and through and retained in said first spring retention fitting, said second end of said third tension member extending through said hole in said second end of said second casing, through said second compression spring and through and retained by said second spring retention fitting such that tension in said tension members compresses said springs, said over-center clip being installed on said third tension member.

2. The heel bail assembly of claim 1 in which said tension members are rigid.

* * * * *